US005338642A

United States Patent [19]

Tanaka et al.

[11] Patent Number: 5,338,642

[45] Date of Patent: Aug. 16, 1994

[54] DIAZO TYPE RECORDING MATERIAL COMPRISING TWO COUPLERS WHEREIN THE NOVEL COUPLER USED IS A BIS-MALONAMIDE

[75] Inventors: Toshiharu Tanaka; Sadao Ishige; Takekatsu Sugiyama; Hirokazu Shimada, all of Shizuoka, Japan

[73] Assignee: Fuji Photo Film Co., Ltd., Kanagawa, Japan

[21] Appl. No.: 997,320

[22] Filed: Dec. 28, 1992

[30] Foreign Application Priority Data

Dec. 27, 1991 [JP] Japan ..... 3-359102

[51] Int. Cl.[5] ..... G03C 1/58

[52] U.S. Cl. ..... 430/173; 430/138; 430/148; 430/180; 430/181; 430/182

[58] Field of Search ..... 430/173, 138, 148, 180, 430/181, 182

[56] References Cited

U.S. PATENT DOCUMENTS

| | | | |
|---|---|---|---|
| 2,533,185 | 12/1950 | Unkauf | 430/173 |
| 3,387,977 | 6/1968 | Habib et al. | 430/173 |
| 3,615,575 | 10/1971 | Rauhut | 430/173 |
| 3,761,263 | 9/1973 | Fleming et al. | 430/148 |
| 4,304,831 | 12/1981 | Matsuda et al. | 430/173 |
| 4,334,004 | 6/1982 | Scheler | 430/173 |
| 4,842,979 | 6/1989 | Ishige et al. | 430/173 |

*Primary Examiner*—Charles L. Bowers, Jr.
*Assistant Examiner*—John S. Chu
*Attorney, Agent, or Firm*—Sughrue, Mion, Zinn, Macpeak & Seas

[57] ABSTRACT

A novel diazo type recording material is provided comprising a recording layer containing at least one light-sensitive diazo compound incorporated in microcapsules and a coupling component which undergoes reaction with said diazo compound in a basic atmosphere to develop a color on a support, wherein said coupling component is a mixture of at least one compound represented by the following general formula [I] and at least one compound represented by the following general formula [II]:

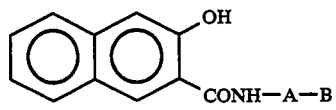

[I]

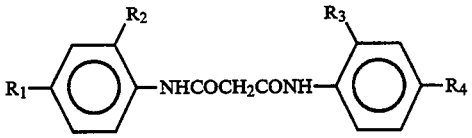

[II]

wherein A represents an alkylene group having from 1 to 22 carbon atoms containing an ether or thioether bond; B represents hydrogen atom, cyclohexyl group, morpholino group or piperidino group; and $R_1$, $R_2$, $R_3$ and $R_4$ each represent hydrogen atom, an alkyl group having from 1 to 5 carbon atoms, alkoxy group having from 1 to 5 carbon atoms or halogen atom.

14 Claims, No Drawings

DIAZO TYPE RECORDING MATERIAL COMPRISING TWO COUPLERS WHEREIN THE NOVEL COUPLER USED IS A BIS-MALONAMIDE

FIELD OF THE INVENTION

The present invention relates to a recording material comprising a light-sensitive diazo compound. More particularly, the present invention relates to a black-developable diazo type recording material having an excellent storage-stability.

BACKGROUND OF THE INVENTION

Because of its inexpensiveness, copying materials utilizing the photosensitivity of diazo compounds have been widely used. These diazo type copying materials can be roughly divided into the following three known types.

The first type is known as wet development type. In this type, a light-sensitive layer comprising a diazo compound and a coupling component as main components is provided on a support. This copying material is superimposed on an original, exposed to light, and then developed with an alkaline solution.

The second type is known as dry development type. This type of copying material is developed with ammonia gas.

The third type is known as heat-developable type. Examples of the heat-developable type copying material include a type of copying material comprising an ammonia gas generator such as urea capable of generating ammonia gas upon heating in a light-sensitive layer, a type of copying material comprising a light-sensitive layer containing an alkali salt of a compound such as trichloroacetic acid which loses acidic properties upon heating, and a type of copying material which utilizes the activation of a diazo compound and a coupling component by heat-melting with a higher fatty acid amide as a coloring aid.

The wet development type copying material is disadvantageous in maintenance and operation, because the use of a developer has much trouble of the replenishment and disposal of the developer and an apparatus therefor is large-sized. This type of copying material is also disadvantageous in that the material which has been just after copy is still wet and thus is not writable, and images thus copied can not withstand prolonged storage.

Further, the dry type copying material also has a trouble of the replenishment of a developer. This type of a copying material is also disadvantageous in that a gas suction apparatus for preventing the resulting ammonia gas from leaking out is needed to cause a large-sized copying apparatus. This type of a copying material is further disadvantageous in that the material which has been just after copy has a strong odor of ammonia.

On the other hand, the heat-developable type copying material is advantageous in maintenance, because it requires no developer unlike the wet development type and the dry development type. However, the heat-developable type also leaves much to be desired. That is, this type of copying material is disadvantageous in that since the development requires a high temperature of 150° C. to 200° C. and must be controlled within ±10° C. from the desired value to inhibit insufficient development or tone change, the cost of the copying machine must be high to obtain an excellent image quality.

In order to withstand such a high temperature development, the diazo compound to be used needs to have a high heat resistance. Such a compound often acts against the formation of a high image density. This trouble can not be avoided also in the development of black tone, which is frequently used.

Many attempts have been made to lower the development temperature to a range of 90° C. to 130° C. However, this approach is disadvantageously accompanied by a reduction in the shelf life of the copying material itself.

Thus, although the heat-developable type copying material is advantageous in maintenance as compared with the wet development type and the dry development type, it does not yet predominate in the diazo copying system.

In other words, in order to obtain a desired color density by heating a material comprising a layer containing a diazo compound, a coupling component and a coloring aid on a support, it is necessary that these components momentarily undergo melting, diffusion and reaction to produce developed dyes. In the case, the color development reaction proceeds gradually even during the storage at room temperature before copying, resulting in coloring and hence staining of the background, which must be white.

These problems can be almost solved by the use of a copying material comprising a heat-developable light-sensitive layer containing a diazo compound, a coupling component and a coloring aid on a support, wherein the diazo compound is incorporated in microcapsules, as described in JP-A-59-91438 (the term "JP-A" as used herein means an "unexamined published Japanese patent application"). However, a black-developable material which can exhibit more excellent color balance has been desired.

The inventors made extensive studies to enhance the black balance in a heat-developable recording material. As a result, it was found that extremely excellent results can be obtained by the combined use of a light-sensitive diazo compound and two or more certain kinds of couplers as couplers for the diazo compound.

SUMMARY OF THE INVENTION

It is therefore an object of the present invention to provide a diazo type recording material which is insusceptible to background staining, exhibits a better storage-stability than ever, and can give a well-balanced black-developed image.

The above mentioned object of the present invention will become more apparent from the following detailed description and examples.

The object of the present invention is accomplished with a diazo type recording material comprising a recording layer containing a light-sensitive diazo compound incorporated in microcapsules and a coupling component which undergoes reaction with said diazo compound in a basic atmosphere to develop a color on a support, characterized in that said coupling component is a mixture of at least one compound represented by the following general formula [I] and at least one compound represented by the following general formula [II]:

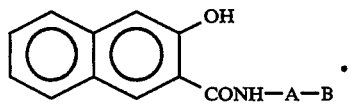

[I]

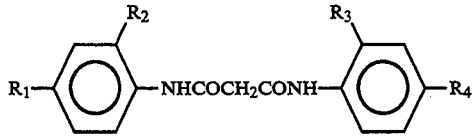

[II]

wherein A represents an alkylene group having from 1 to 22 carbon atoms which may contain an ether or thioether bond; B represents hydrogen atom, cyclohexyl group, morpholino group or piperidino group; and $R_1$, $R_2$, $R_3$ and $R_4$ each represent hydrogen atom, an alkyl group having from 1 to 5 carbon atoms, an alkoxy group having from 1 to 5 carbon atoms or halogen atom.

DETAIL DESCRIPTION OF THE INVENTION

Alkylene group represented by A having from 1 to 22 carbon atoms in the formula [I] may have an ether or thioether bond therein, and preferably includes ethylene group, propylene group, trimethylene group, hexamethylene group, $-(CH_2)_{12}$, $-(CH_2)_{14}$, $-(CH_2)_{22}$, $-(CH_2)_2-O-(CH_2)_2$, $-(CH_2)_2-O-(CH_2)_{18}$ and $-(CH_2)_3-S-(CH_2)_{12}$.

When $R_1$, $R_2$, $R_3$ and $R_4$ each represents an alkyl group, the alkyl group preferably includes methyl group, ethyl group, propyl group, isopropyl group, butyl group, isobutyl group, t-butyl group.

When $R_1$, $R_2$, $R_3$ and $R_4$ each represents an alkoxy group, the alkoxy group preferably includes methoxy group, ethoxy group, propoxy group and butoxy group.

When $R_1$, $R_2$, $R_3$ and $R_4$ each represents a halogen atom, the halogen atom preferably includes chlorine atom, fluorine atom and bromine atom.

The diazo compound to be used in the present invention can be properly selected from known diazo compounds which undergo coupling reaction with a coupling component to develop a color and at the same time undergo photodecomposition, such as photodecomposable diazonium salt, photodecomposable diazosulfonate and photodecomposable diazoamino compound.

In the present invention, among these diazo compounds, a diazonium salt represented by the general formula $ArN_2^+X^-$ (wherein Ar represents a substituted or unsubstituted aromatic moiety, such as, a benzene ring and a naphthalene ring, $N_2^+$ represents a diazonium group, and $X^-$ represents an acid anion, examples of substituent on the aromatic moiety including alkyl amino group, dialkyl amino group, acylamino group, morpholino group, piperazinyl group, alkoxy group, alkylthio group, halogen and alkyl group) is preferably used from the standpoint of photosensitivity and image density.

Specific examples of the diazonium salt include 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-toluylmercapto-2,5-diethoxybenzene, and 4-diazo-1,4-methoxybenzoylamino-2,5-diethoxybenzene.

Specific examples of the acid composing acid anion of a diazonium salt include $C_nF_{2n-1}COOH$ (in which n is an integer 1 to 9), $C_mF_{2m-1}SO_3H$ (in which m is an integer 1 to 9), boron tetrafluoride, tetraphenylboron, hexafluorophosphoric acid, aromatic carboxylic acid, and metallic halide in which metal preferably belongs to group IIB or IVA in the periodic table, such as zinc halide, tin halide, e.g., zinc chloride and tin chloride.

The coupling component to be used in the present invention is a compound which undergoes coupling with a diazo compound in a basic atmosphere, preferably in a pH range of 7 to 10, to form a dye.

In the present invention, from the standpoint of development of black color with an excellent color balance, a mixture of at least one compound represented by the general formula [I] and at least one compound represented by the general formula [II] is used.

Specific examples of the compound represented by the general formula [I] include 2-hydroxy-3-naphthoic acid ethylamide, 2-hydroxy-3-naphthoic acid propylamide, 2-hydroxy-3-naphthoic acid octylamide, 2-hydroxy-3-naphthoic acid laurylamide, 2-hydroxy-3-naphthoic acid myristylamide, 2-hydroxy-3-naphthoic acid palmitylamide, 2-hydroxy-3-naphthoic acid stearylamide, 2-hydroxy-3-naphthoic acid behenylamide, 2-hydroxy-3-naphthoic acid (2-ethylhexyl)amide, 2-hydroxy-3-naphthoic acid morpholinopropylamide, 2-hydroxy3-naphthoic acid (ethyloxy)ethylamide, 2-hydroxy-3-naphthoic acid (stearyloxy)ethylamide, 2-hydroxy-3-naphthoic acid (ethyloxy)propylamide, 2-hydroxy-3-naphthoic acid (stearyloxy)propylamide, 2-hydroxy-3-naphthoic acid (lauryloxy)propylamide, 2-hydroxy-3-naphthoic acid (stearylthio)propylamide and 2-hydroxy-3-naphthoic acid (laurylthio)propylamide.

Of the compounds of the general formula [I], 2-hydroxy-3-naphthoic acid laurylamide, 2-hydroxy-3-naphthoic acid myristylamide and 2-hydroxy-3-naphthoic acid stearylamide are more preferable.

Specific examples of the compound represented by the general formula [II] include N,N'-diphenylmalonamide, N,N'-bis(o-chlorophenyl)malonamide, N,N'-bis(o-fluorophenyl)malonamide, N,N'-bis(o-methylphenyl)malonamide, N,N'-bis(o-ethylphenyl)malonamide, N,N'-bis(p-methylphenyl)malonamide, N,N'-bis(p-ethylphenyl)malonamide, N,N'-bis(p-propylphenyl)malonamide, N,N'-bis(p-butylphenyl)malonamide, N,N'-bis(o-methoxyphenyl)malonamide, N,N'-bis(o-ethoxyphenyl)malonamide, N,N'-bis(p-methoxyphenyl)malonamide, N,N'-bis(p-ethoxyphenyl)malonamide, N,N'-bis(o-ethoxyphenyl)malonamide, N,N'-bis(2-chloro-4-methylphenyl)malonamide, N,N'-bis(2-chloro-4-ethylphenyl)malonamide, N,N'-bis(2-chloro-4-methoxyphenyl)malonamide, N,N'-bis(2-chloro-4-ethoxyphenyl)malonamide, N,N'-bis(2,4-dimethylphenyl)malonamide, N,N'-bis(2,4-diethylphenyl)malonamide, N-(2-chlorophenyl)-N'-(2-methoxyphenyl)malonamide, N-(2-chlorophenyl)-N'-(2-bromophenyl)malonamide, N-(2-methoxyphenyl)-N'-(2-ethoxyphenyl)malonamide, N-(2-chloro-4-methylphenyl)-N'-(2-chlorophenyl)malonamide, N-(2-chloro-4-methoxyphenyl)-N'-(2-chloro-4-methylphenyl)-malonamide, and N-(2,4-dichlorophenyl)N'-(2-chlorophenyl)malonamide.

In the present invention, an excellent black color can be reproduced by properly adjusting the content of the coupling components represented by the general formulae [I] and [II].

In the present invention, a basic substance which serves as a coloring aid is preferably added to the recording layer, but outside of microcapsules, for the purpose of rendering the system basic to accelerate coupling reaction during heat development. As such a basic substance there can be used a slightly water-soluble or water-insoluble basic substance or a substance which generates an alkali on heating.

Specific examples of such a basic substance include nitrogen-containing compounds such as inorganic and organic ammonium salts, organic amines, amides, urea, thiourea and derivatives thereof, thiazoles, pyrroles, pyrimidines, piperazines, guanidines, indoles, imidazoles, imidazolines, triazoles, morpholines, piperidines, amidines, formamidines and pyridines. Most preferable example thereof includes triphenyl guanidine. Two or more kinds of such basic substances may be used in combination.

In the present invention, the light-sensitive layer (the recording layer) may contain a phenol derivative, naphthol derivative, alkoxy-substituted benzene, alkoxy-substituted naphthalene, hydroxyl compound, azide compound, sulfonamide compound, etc. incorporated therein to effect heat development rapidly and completely with a low energy. Preferable examples of the compounds include bisphenol A, 2,4-di-tert-butyl phenol, 2-benzyloxynaphthalene, methoxybenzene, 2,6-bishydroxymethyl-4-methylphenol and p-toluenesulfonamide. These compounds serve to lower the melting point of the coupling component or the basic substance or improve the heat transmission of the wall of the microcapsules. Consequently, these compounds serve as coloring aids, providing a high color density.

Coloring aids to be used in the present invention include a heat-fusible substance. Such a heat-fusible substance is a substance having a melting point of 50° C. to 150° C. which stays solid at normal temperature but fuses on heating. Such a substance dissolves the diazo compound, coupling component or basic substance therein.

Specific examples of the above mentioned heat-fusible substance include fatty acid amide, N-substituted fatty acid amide, ketone compound, urea compound, and ester, such as stearic acid amide and palmitic acid amide.

In the present invention, from the standpoint of improvement in the storage stability of the background of the recording material, the recording layer may contain a reducing metallic salt incorporated therein.

Specific examples of the above mentioned reducing metallic salt include $SnCl_2$, $SnBr_2$, $TiCl_3$, $CrCl_2$, $FeSO_4$, and $VCl_2$. Particularly preferred among these metallic salts is $SnCl_2$.

The recording layer may contain at least one of the above mentioned reducing metallic salts incorporated therein to inhibit the background stain before recording.

The content of the above mentioned metallic salt is preferably in the range of 0.001 to 0.01 g/m$^2$. If this content is lower than 0.001 g/m$^2$, there is exerted no effect of inhibiting the background stain. If this content is higher than 0.01 g/m$^2$, the heat sensitivity of the recording layer is disadvantageously reduced.

The metallic salt may be incorporated in any one or more of portions inside, outside and in the wall of the microcapsules. In particular, the metallic salt is preferably incorporated in the same portion as the basic substance.

In the present invention, the coupling component is preferably used in an amount of 0.1 to 10 parts by weight and more preferably 0.5 to 5 parts by weight based on 1 part by weight of diazo compound. Compounds of formula [I] and formula [II] are preferably used in a ratio of 8:2 to 2:8 by weight. The coloring aid is preferably used in an amount of 0.1 to 20 parts by weight and more preferably 0.5 to 10 parts by weight based on 1 part by weight of diazo compound. The diazo compound is preferably coated in an amount of 0.05 to 5.0 g/m$^2$ and more preferably 0.1 to 3 g/m$^2$.

The microcapsules are prepared by dissolving a core substance in a nonaqueous solvent, mixing the solution with an aqueous solution containing at least a protective colloid with stirring for emulsification, and then forming a wall of a high molecular substance around the oil drops. The reactant from which the high molecular substance is produced is incorporated in the interior and/or exterior of the oil drops. Specific examples of such a high molecular substance include polyurethane, polyurea, polyamide, polyester, polycarbonate, urea-formaldehyde resin, and melamine resin.

Two or more kinds of such high molecular substances can be used in combination. Preferred among these high molecular substances are polyurethane, polyurea, polyamide, polyester, and polycarbonate. Further preferred among these high molecular substances are polyurethane, and polyurea. Such a high molecular substance preferably exhibits a melting point of 150° C. or higher and thus does not fuse at the recording temperature.

The microcapsules can be prepared from an emulsion containing the components to be microcapsulized in an amount of 0.2 % by weight or more.

The microcapsules to be used in the present invention are preferably microcapsules substantially free of solvent obtained by dissolving a diazo compound and a coupling component in a low boiling nonaqueous solvent with a capsule wall-forming monomer, and then distilling off the solvent while allowing the capsule wall-forming monomer to undergo polmerization reaction.

The polymer from which the microcapsule wall is formed can be obtained by polymerizing the monomer in accordance with the above mentioned method. The amount of the monomer to be used is determined such that the resulting microcapsules have an average grain diameter of 0.3 to 12 μm and a wall thickness of 0.01 to 0.3 μm.

In such a structure that the diazo compound is incorporated in the microcapsules thus prepared, the contact of the diazo compound with the coupling component can be inhibited.

The coupling component, basic substance, coloring aid, etc. to be used in the present invention, which are not incorporated in the microcapsules, are used in the form of solid dispersion with a water-soluble high molecular compound formed by a sand mill. As such a water-soluble high molecular compound there can be preferably used the high molecular compound to be used for the preparation of the microcapsules (for example, as is disclosed in JP-A-59-190886). In this case, the coupling component and the coloring aid are each charged in an amount of 5 to 40% by weight based on the water-soluble high molecular compound solution.

The grains thus dispersed preferably have a size of 10 μm or less

The coating solution of the present invention may be coated by a well-known coating method such as bar coating method, blade coating method, air knife coating method, gravure coating method, doctor coating method, slide coating method, roll coating method, spray coating method, dip coating method, curtain coating method, and methods described in Yuji Harazaki, "Coating Engineering", Tomokura Shoten, 1973, page 253.

The light-sensitive layer (the recording layer) of the present invention is adjusted such that the dry solid content is in the range of 2.5 to 30 g/m$^2$.

In the recording material of the present invention, the diazo compound, coupling component and basic substance may be incorporated in the same layer, as mentioned above. However, a laminate configuration in which these components are incorporated in different layers may be employed. An alternate configuration is such that the light-sensitive layer is coated on an interlayer provided on a support as described in JP-A-61-54980. Moreover, a protective layer may be provided on the light-sensitive layer.

The support to be used in the present invention may be transparent or opaque.

The transparent support prefeably exhibits not only a high transparency but also a dimensional stability high enough to inhibit deformation during heat recording. Such a support preferably has a thickness of 10 μm to 200 μm.

Specific examples of such a transparent support include polyester film such as polyethylene terephthalate and polybutyrene terephthalate, cellulose derivative film such as cellulose triacetate film, polyolefin film such as polystyrene film, polypropylene film and polyethylene film, polyimide film, polyvinyl chloride film, polyvinylidene chloride film, polyacryl film, and polycarbonate film. These films may be used singly or in a laminated form.

On the other hand, as the opaque support for the recording material there may be used a paper, a synthetic paper, an aluminized base, a support obtained by coating a pigment on the above mentioned transparent supports, etc. As the paper support there can be advantageously used a neutral paper with a heat extract pH of 6 to 9 obtained by sizing a paper with a neutral sizing agent such as alkylketene dimer (as described in JP-A-55-14281) from the standpoint of aging preservability.

The formation of an image on the recording material of the present invention can be accomplished by a process which comprises imagewise exposing the recording material to light corresponding to the original to decompose the diazo compound on the exposed portion, and then heating the entire recording material to allow the diazo compound on the unexposed portion to undergo reaction with the coupler to develop a color, or previously imagewise heat-recording on the recording material with a heat pen or thermal head, and then irradiating the entire recording material with light to decompose and fix the diazo compound on the undeveloped portion.

The imagewise exposure corresponding to the original can be easily conducted in contact with a transparent original. Other exposure means such as laser exposure may be employed.

As the light source for exposure there can be used various fluorescent tubes, xenon lamps, mercury vapor lamps, etc. In this case, the emission spectrum of the light source preferably coincides approximately with the absorption spectrum of the diazo compound used.

As the heating means for use in the development process wherein the entire surface of the light-sensitive layer in the recording material is heated for development there can be used infrared ray, high frequency, heat block, heat roller, etc.

The present invention will be further described in the following examples, but the present invention should not be construed as being limited thereto. The unit "parts" indicate "parts by weight".

EXAMPLE 1

Preparation of Capsule Solution 3 parts of a diazonium salt represented by the following general formula [III] were dissolved in 13 parts of ethyl acetate.

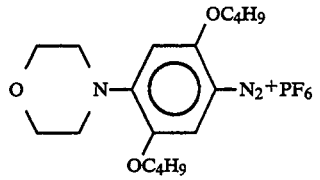

[III]

To the diazo compound solution thus obtained were added 7 parts of a 75 wt. % ethyl acetate solution (Takenate D110N manufactured by Takeda Yakuhin Industrial Co., Ltd.) of a 1:3 adduct of trimethylol propane and xylylene diisocyanate

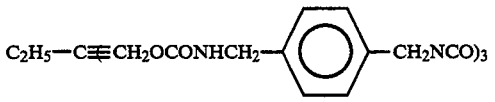

with stirring.

The ethyl acetate solution of diazonium salt and isocyanate thus obtained was emulsion-dispersed in an aqueous solution containing 3.5 parts of polyvinyl alcohol (PVA217E available from Kuraray Co., Ltd.) in 60 parts of water to obtain an emulsion having an average grain diameter of 1.0 μm. To the emulsion thus obtained were added 20 parts of water. The mixture was heated to a temperature of 40° C. with stirring. Thus, the isocyanate as a wall-forming substance was allowed to undergo reaction for 3 hours to obtain microcapsules with an average grain diameter of 1 μm containing a diazo compound as a core substance.

The above mentioned capsulization reaction was conducted under reduced pressure of 400 to 500 mmHg established by a tap aspirator.

Preparation of Coupler Dispersion 2.5 parts of 2-hydroxy-3-naphthoic acid morpholinopropylamide, 2.5 parts of N,N'-bis(o-fluorophenyl)-malonamide, 10 parts of a compound represented by the following general formula [V] as a coloring aid and 5 parts of triphenyl guanidine were dispersed in 100 parts of a 5 wt. % aqueous solution of polyvinyl alcohol for 24 hours by a sand mill to obtain a dispersion having an average grain diameter of 3 μm.

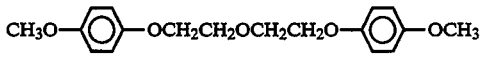

[V]

Preparation of Coating Solution

To 8 parts of the solution of capsulized diazonium salt thus obtained were added 25 parts of the coupler dispersion, 2 parts of a 40 wt. % calcium carbonate (Unibar 70 available from Shiraishi Kogyo K.K.) and 0.5 parts of water to obtain a coating solution.

Preparation of Recording Material

The coating solution thus obtained was bar-coated on a smooth quality paper (76 g/m$^2$) by means of a coating bar to a dry thickness of 5 g/m$^2$, and then dried at a temperature of 50° C. for 3 minutes to prepare a recording material.

Evaluation of Black Developability and Preservability

The recording material thus obtained was heated in a gradient heat tester having a heat gradient from 50° C. to 150° C. for 5 seconds, and then entirely irradiated with ultraviolet rays for light fixation. As a result, a black tone image was developed at every temperature. The black images thus obtained were measured for density by a Macbeth densitometer. The maximum density was 1.21.

In order to evaluate the storage-stability (preservability) of the unused recording material (recording material before use), the specimen was subjected to a forced deterioration test in a dark place in an atmosphere of 40° C. and 90% RH for 1 day. The background density was measured before and after the test by means of a Macbeth densitometer. As a result, the background density before the test was 0.11 while that after the test was 0.14. This demonstrates that the recording material of the present invention exhibits an excellent storage-stability of unused recording material.

EXAMPLE 2

A recording material was prepared in the same manner as in Example 1 except that 2-hydroxy-3-naphthoic acid myristylamide was used instead of 2-hydroxy-3-naphthoic acid morpholinopropylamide.

Evaluation of Black Developabilit and Storage-Stability

The recording material thus obtained was exposed to light in contact with an optical wedge having a transmission density of 0.05 to 2.30 by means of a diazo copying machine, and then heat-developed by means of a 130° C. heat roll. As a result, the intermediate density zone was developed black. The black image thus obtained was measured for maximum density by a Macbeth densitometer. The maximum density was 1.35. In order to evaluate the storage-stability of the unused recording material, the specimen was subjected to a forced deterioration test in a dark place in an atmosphere of 40° C. and 90% RH for 1 day. The background density was measured before and after the test by means of a Macbeth densitometer. As a result, the background density before the test was 0.11 while that after the test was 0.13. This demonstrates that the recording material of the present invention exhibits an excellent storage-stability of unused recording material.

EXAMPLE 3

A recording material was prepared in the same manner as in Example 1 except that N,N'-bis(o-chlorophenyl)-malonamide was used instead of N,N'-bis(o-fluorophenyl)-malonamide. An image was recorded on this recording material in the same manner as in Example 2. The recording material was then measured for background density. As a result, the black maximum density was 1.32, and the background density before the test was 0.11 while that after the test was 0.13. This demonstrates that the specimen exhibits an excellent storage-stability of unused recording material.

EXAMPLE 4

A recording material was prepared in the same manner as in Example 1 except that 2-hydroxy-3-naphthoic acid (lauryloxy)propylamide was used instead of 2-hydroxy-3-naphthoic acid morpholinopropylamide. An image was recorded on this recording material in the same manner as in Example 2. The recording material was then measured for background density. As a result, the black maximum density was 1.29, and the background density before the test was 0.12 while that after the test was 0.14. This demonstrates that the specimen exhibits an excellent storage-stability of unused recording material.

COMPARATIVE EXAMPLE 1

The same procedure as Example 1 was followed to prepare the recording material, except for using 5.0 parts of N,N'-bis(o-fluorophenyl) malonamide instead of the combination of 2-hydroxy-3-naphthoic acid morpholinopropylamide and N,N'-bis(o-fluorophenyl)-malonamide.

The recording material thus obtained was exposed and heat-developed to obtain a developed image, in the same 20 manner as in Example 2.

The image thus obtained was not black, but orange.

COMPARATIVE EXAMPLE 2

The same procedure as Example 1 was followed to prepare the recording material, except for using 5.0 parts of 2-hydroxy-3-naphthoic acid morpholinopropylamide instead of the combination of 2-hydroxy-3-naphthoic acid morpholinopropylamide and N,N'-bis-(o-fluorophenyl)malonamide.

The recording material thus obtained was exposed and heat-developed to obtain a developed image, in the same manner as in Example 2.

The image thus obtained was not black, but blue.

As mentioned above, the diazo type recording material of the present invention comprises two certain kinds of coupling components in combination. Thus, the diazo type recording material of the present invention is a recording material which exhibits an excellent storage-stability (preservability) and provides a black image having a high density and an extremely high color tone balance.

While the invention has been described in detail and with reference to specific embodiments thereof, it will be apparent to one skilled in the art that various changes and modifications can be made therein without departing from the spirit and scope thereof.

What is claimed is:

1. A diazo type recording material comprising on a support at least one recording layer containing a light-sensitive diazo compound incorporated in microcapsules and a coupling component which undergoes reaction with said diazo compound in a basic atmosphere to develop a color, wherein said coupling component is a mixture of at least one compound represented by the following general formula (I) and at least one compound represented by the following general formula (II):

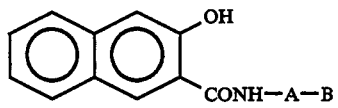

(I)

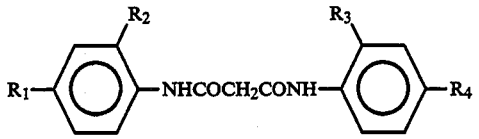

(II)

wherein A represents an alkylene group having from 1 to 22 carbon atoms; B represents a hydrogen atom, cyclohexyl group, morpholino group or piperidino group; and $R_1$, $R_2$, $R_3$ and $R_4$ each represent a hydrogen atom, an alkyl group having from 1 to 5 carbon atoms, an alkoxy group having from 1 to 5 carbon atoms or halogen atom.

2. The diazo type recording material as claimed in claim 1, wherein said alkylene group represented by A is ethyl, propyl, octyl, lauryl, mirystyl, palmityl, stearyl, behenyl, 2-ethylhexyl, morpholinopropyl, ethyloxyethyl, stearyloxyethyl, ethyloxypropyl, stearyloxypropyl, lauryloxypropyl, stearylthiopropyl or laurylthiopropyl.

3. The diazo type recording material as claimed in claim 1, wherein said alkyl group represented by $R_1$, $R_2$, $R_3$ and $R_4$ is methyl group, ethyl group, propyl group, butyl group and pentyl group, and said alkoxy group represented by $R_1$, $R_2$, $R_3$ and $R_4$ is methoxy group, ethoxy group, propoxy group, butoxy group and pentoxy group.

4. The diazo type recording material as claimed in claim 1, wherein said light-sensitive diazo compound is photodecomposable diazonium salt, photodecomposable diazosulfonate and photodecomposable diazoamino compound.

5. The diazo type recording material as claimed in claim 1, wherein said light-sensitive diazo compound is photodecomposable diazonium salt.

6. The diazo type recording material as claimed in claim 1, wherein said coupling component is used in an amount of 0.1 to 10 parts by weight based on 1 part by weight of diazo compound.

7. The diazo type recording material as claimed in claim 1, wherein said recording layer contains a coloring aid.

8. The diazo type recording material as claimed in claim 7, wherein said coloring aid is used in an amount of 0.1 to 20 parts by weight based on 1 part by weight of diazo compound.

9. The diazo type recording material as claimed in claim 6, wherein said coloring aid is a basic substance.

10. The diazo type recording material as claimed in claim 9, wherein said basic substance is nitrogen-containing compounds.

11. The diazo type recording material as claimed in claim 6, wherein said coloring aid is at least one compound selected from the group consisting of phenol derivative, naphthol derivative, alkoxy-substituted benzene, alkoxy-substituted naphthalene, hydroxyl compound, azide compound and sulfonamide compound.

12. The diazo type recording material as claimed in claim 6, wherein said coloring aid is a heat-fusible substance having a melting point of 50° C. to 150° C. which stays solid at normal temperature but fuses on heating.

13. The diazo type recording material as claimed in claim 1, wherein said recording layer contains a reducing metallic salt.

14. The diazo type recording material as claimed in claim 12, wherein said reducing metallic salt is selected from $SnCl_2$, $SnBr_2$, $TiCl_3$, $CrCl_2$, $FeSO_4$ and $VCl_2$.

* * * * *